US008912993B2

(12) United States Patent
Chung et al.

(10) Patent No.: US 8,912,993 B2
(45) Date of Patent: Dec. 16, 2014

(54) SCAN DRIVING DEVICE AND DRIVING METHOD THEREOF

(75) Inventors: Kyung-Hoon Chung, Yongin (KR); Seong-Il Park, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 126 days.

(21) Appl. No.: 13/426,740

(22) Filed: Mar. 22, 2012

(65) Prior Publication Data

US 2013/0120346 A1 May 16, 2013

(30) Foreign Application Priority Data

Nov. 10, 2011 (KR) ..... 10-2011-0117078

(51) Int. Cl.
*G09G 3/36* (2006.01)
*G09G 5/00* (2006.01)

(52) U.S. Cl.
CPC ..... *G09G 5/00* (2013.01)
USPC ..... 345/98; 345/204

(58) Field of Classification Search
CPC ..... G09G 3/34
USPC ..... 345/87, 92, 204, 205, 98, 100
See application file for complete search history.

(56) References Cited

U.S. PATENT DOCUMENTS

| | | | | |
|---|---|---|---|---|
| 2008/0062071 | A1* | 3/2008 | Jeong | 345/46 |
| 2008/0062097 | A1* | 3/2008 | Jeong et al. | 345/84 |
| 2011/0080393 | A1* | 4/2011 | Kim et al. | 345/208 |
| 2011/0109599 | A1* | 5/2011 | Han | 345/204 |

FOREIGN PATENT DOCUMENTS

| | | | |
|---|---|---|---|
| JP | 2009-188867 | A | 8/2009 |
| KR | 10-2006-0018772 | A | 3/2006 |
| KR | 10-2007-0022550 | A | 2/2007 |
| KR | 10-2007-0053209 | A | 5/2007 |

* cited by examiner

*Primary Examiner* — Pegeman Karimi
(74) *Attorney, Agent, or Firm* — Lee & Morse, P.C.

(57) ABSTRACT

A scan driving device including scan driving blocks including a first node receiving a second-voltage according to a signal input to a first-input terminal, a second node receiving a first-voltage according to a signal input to the first-input terminal, and receiving an input signal according to a clock signal input to a second-input terminal, a first transistor connected to the first node, the first power source, and an output terminal, and a second transistor connected to the second node and the output terminal and configured to receive a clock signal input to a third-input terminal, wherein, during the initial driving period, the input signal is applied with a gate-off-voltage, and clock signals input to the first-, second-, and third-input terminals are applied with a gate-on-voltage to reset a voltage at the first node with the gate-on-voltage and reset a voltage at the second node with the gate-off-voltage.

20 Claims, 11 Drawing Sheets

SCAN DRIVING DEVICE AND DRIVING METHOD THEREOF

CROSS-REFERENCE TO RELATED APPLICATION

This application claims priority to and the benefit of Korean Patent Application No. 10-2011-0117078 filed in the Korean Intellectual Property Office on Nov. 10, 2011, the entire contents of which are incorporated herein by reference.

BACKGROUND

1. Field

Embodiments relate to a scan driving device and a driving method thereof. More particularly, embodiments relate to a scan driving device for preventing an abnormal output of a scan signal and a driving method thereof.

2. Description of the Related Art

A display device sequentially applies a scan signal with a gate on voltage to a plurality of scan lines and applies a data signal corresponding to the scan signal with a gate on voltage to a plurality of data lines so as to display an image.

A scan driving device has a structure in which a plurality of scan driving blocks are sequentially disposed in order to sequentially output the scan signal with a gate on voltage. A next scan driving block receives the scan signal from the previously arranged scan driving block to generate a scan signal so a plurality of scan driving blocks can sequentially output the scan signal with a gate on voltage.

At the initial drive of the scan driving device, a circuit starts its operation while not knowing initial voltage states of a plurality of scan driving blocks, so a scan signal with an abnormal waveform can be output.

The above information disclosed in this Background section is only for enhancement of understanding of the background of embodiments and therefore it may contain information that does not form the prior art that is already known in this country to a person of ordinary skill in the art.

SUMMARY

One or more embodiments provide a scan driving device configured to prevent an output of a scan signal with an abnormal waveform during an initial driving period thereof.

One or more embodiments provide a scan driving device including a plurality of scan driving blocks that are sequentially arranged, wherein the scan driving blocks respectively include a first node for receiving a second power source voltage according to a clock signal that is input to a first clock signal input terminal, a second node for receiving a first power source voltage according to a clock signal that is input to the first clock signal input terminal, and receiving an input signal according to a clock signal that is input to a second clock signal input terminal, a first transistor including a gate electrode that is connected to the first node, a first electrode that is connected to the first power source voltage, and a second electrode that is connected to an output terminal, and a second transistor including a gate electrode that is connected to the second node, a first electrode for receiving a clock signal that is input to a third clock signal input terminal, and a second electrode that is connected to the output terminal, wherein, during an initial driving period thereof, the input signal is applied with a gate off voltage, and a clock signal that is input to the first clock signal input terminal, a clock signal that is input to the second clock signal input terminal, and a clock signal that is input to the third clock signal input terminal are applied with a gate on voltage to reset a voltage at the first node with the gate on voltage and reset a voltage at the second node with the gate off voltage.

The scan driving blocks output scan signals with a gate off voltage when a voltage at the first node is reset with a gate on voltage and a voltage at the second node is reset with a gate off voltage.

The input signal represents a scan signal of a previously arranged scan driving block from among the scan driving blocks.

The scan driving device further includes a first capacitor including a first electrode connected to a gate electrode of the second transistor and a second electrode connected to a second electrode of the second transistor.

The scan driving device further includes a third transistor including a gate electrode connected to the first clock signal input terminal, a first electrode connected to the second power source voltage, and a second electrode connected to the first node.

The scan driving device further includes a fourth transistor including a gate electrode connected to the first node, a first electrode connected to the first power source voltage, and a second electrode connected to the second node.

The scan driving device further includes a fifth transistor including a gate electrode connected to the second clock signal input terminal, a first electrode for receiving the input signal, and a second electrode connected to the second node.

The scan driving device further includes a sixth transistor including a gate electrode for receiving the input signal, a first electrode connected to the first power source voltage, and a second electrode connected to the first node.

The scan driving device further includes a second capacitor including a first electrode connected to the first power source voltage and a second electrode connected to the first node.

The scan driving device further includes a seventh transistor including a gate electrode for receiving a floating signal, a first electrode connected to the first power source voltage, and a second electrode connected to the second node.

The scan driving device further includes an eighth transistor including a gate electrode connected to the floating signal input terminal, a first electrode connected to the first power source voltage, and a second electrode connected to the first node.

Another embodiment of the present invention provides a method for driving a scan driving device including a plurality of scan driving blocks including a first transistor having a gate electrode connected to a first node and transmitting a first power source voltage to an output terminal and a second transistor having a gate electrode connected to a second node and transmitting a clock signal to the output terminal, including resetting the first node of the plurality of scan driving blocks with a gate on voltage, respectively, and resetting the second node of the scan driving blocks with a gate off voltage to reset the scan driving blocks; and controlling the scan driving blocks to sequentially output scan signals.

The resetting of a plurality of scan driving blocks includes applying a clock signal that is input to the first clock signal input terminal that is connected to a gate electrode of a third transistor for transmitting a second power source voltage to the first node with a gate on voltage.

The applying of a clock signal that is input to the first clock signal input terminal with a gate on voltage includes turning on a fourth transistor by the second power source voltage to transmit the first power source voltage to the second node, the fourth transistor having a gate electrode connected to the first node and transmitting the first power source voltage to the second node.

The resetting of a plurality of scan driving blocks includes allowing the scan driving blocks to output scan signals with a gate off voltage when the voltage at the first node is reset with a gate on voltage and the voltage at the second node is reset with a gate off voltage.

The resetting of a plurality of scan driving blocks further includes applying a clock signal that is input to the second clock signal input terminal that is connected to a gate electrode of a fifth transistor for transmitting an input signal to the second node with a gate on voltage.

The input signal represents a scan signal of the gate off voltage of the previously arranged scan driving block.

The resetting of a plurality of scan driving blocks further includes turning off a sixth transistor for transmitting the first power source voltage to the first node according to the input signal.

The resetting of a plurality of scan driving blocks further includes turning off a seventh transistor for transmitting the first power source voltage to the second node according to a floating signal and an eighth transistor for transmitting the first power source voltage to the first node according to the floating signal.

One or more embodiments provide a method for driving a scan driving device including a plurality of scan driving blocks including a first transistor having a gate electrode connected to a first node and transmitting a first power source voltage to an output terminal, a second transistor having a gate electrode connected to a second node and transmitting a clock signal to the output terminal, a third transistor for transmitting a gate off voltage to the first node according to a floating signal, and a fourth transistor for transmitting a gate off voltage to the second node according to the floating signal, including: floating the output terminal by transmitting the gate off voltage to the first node and the second node of the scan driving blocks according to the floating signal; resetting the first node of the scan driving blocks with a gate on voltage and resetting the second node of the scan driving blocks with the gate off voltage to reset the scan driving blocks; and allowing the scan driving blocks to sequentially output scan signals.

In one or more embodiments, when the scan driving device is initially driven, a circuit of a plurality of scan driving blocks is reset to prevent the scan signal with an abnormal waveform from being output, and control to output a scan signal with a normal waveform.

DETAILED DESCRIPTION

Figure 1:
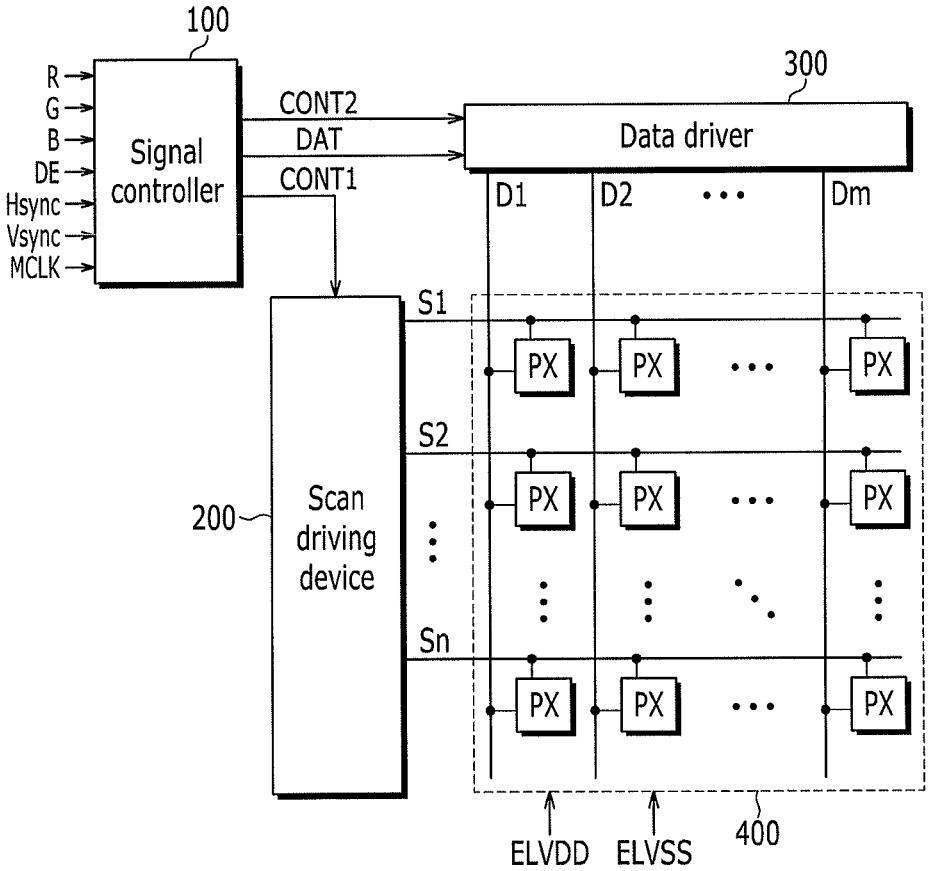
FIG. 1 shows a block diagram of a display device according to an exemplary embodiment.

In the following detailed description, only certain exemplary embodiments have been shown and described, simply by way of illustration. As those skilled in the art would realize, the described embodiments may be modified in various different ways, all without departing from the spirit or scope of the present invention.

In various exemplary embodiments, the same reference numerals are used for elements having the same configuration and will be representatively described in a first exemplary embodiment, and, in general, in the description of other exemplary embodiments, only elements different from those of the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 shows a block diagram of a display device according to an exemplary embodiment.

Referring to FIG. 1, the display device includes a signal controller 100, a scan driving device 200, a data driver 300, and a display 400.

The signal controller 100 receives video signals (R, G, B) and an input control signal from an external device. The video signals (R, G, B) include luminance information of respective pixels (PX), and the luminance has a predetermined number of grayscales, such as, $1024=2^{10}$, $256=2^{8}$, or $64=2^{6}$. The input control signal can be a vertical synchronization signal (Vsync), a horizontal synchronization signal (Hsync), a main clock signal (MCLK), and a data enable signal (DE).

The signal controller 100 may process the input video signals (R, G, B) according to an operational condition of the display 400 and the data driver 300 by using the input video signals (R, G, B) and the input control signal, and may generate a scan control signal (CONT1), a data control signal (CONT2), and an image data signal (DAT). The signal controller 100 transmits the scan control signal (CONT1) to the scan driving device 200. The signal controller 100 transmits the data control signal (CONT2) and the image data signal (DAT) to the data driver 300.

The display 400 includes a plurality of scan lines S1-Sn, a plurality of data lines D1-Dm, and a plurality of pixels (PX) connected to the signal lines (S1-Sn, D1-Dm) and arranged in a matrix form. The scan lines S1-Sn are substantially extended in a row direction and are substantially in parallel with each other. The data lines D1-Dm are substantially extended in a column direction and are substantially in parallel with each other. The pixels (PX) of the display 400 receive a first power source voltage (ELVDD) and a second power source voltage (ELVSS) from an external source.

The scan driving device 200 is connected to the scan lines S1-Sn, and applies a scan signal that is generated by a combination of a gate on voltage (Von) for turning on application of a data signal to the pixel (PX) and a gate off voltage (Voff) for turning off the application thereof according to the scan control signal (CONT 1) to the scan lines S1-Sn.

The scan control signal (CONT1) includes a scan start signal (SSP) and a clock signal (SCLK). The scan start signal (SSP) generates a first scan signal for displaying an image of a single frame. The clock signal (SCLK) functioning as a synchronization signal sequentially applies the scan signal to the scan lines S1-Sn.

The data driver 300 is connected to the data lines D1-Dm and selects a gray voltage according to the image data signal (DAT). The data driver 300 applies the gray voltage selected by the data control signal (CONT2) to the data lines D1-Dm as a data signal.

The above-described driving devices, e.g., the signal controller 100, the scan driving device 200, and the data driver 300, can be installed outside a pixel area as at least one integrated circuit chip, can be installed on a flexible printed circuit film, can be attached to the display 400 as a tape carrier package (TCP), can be installed on an additional printed circuit board, or can be integrated outside the pixel area together with the signal lines (S1-Sn, D1-Dm).

Figure 2:
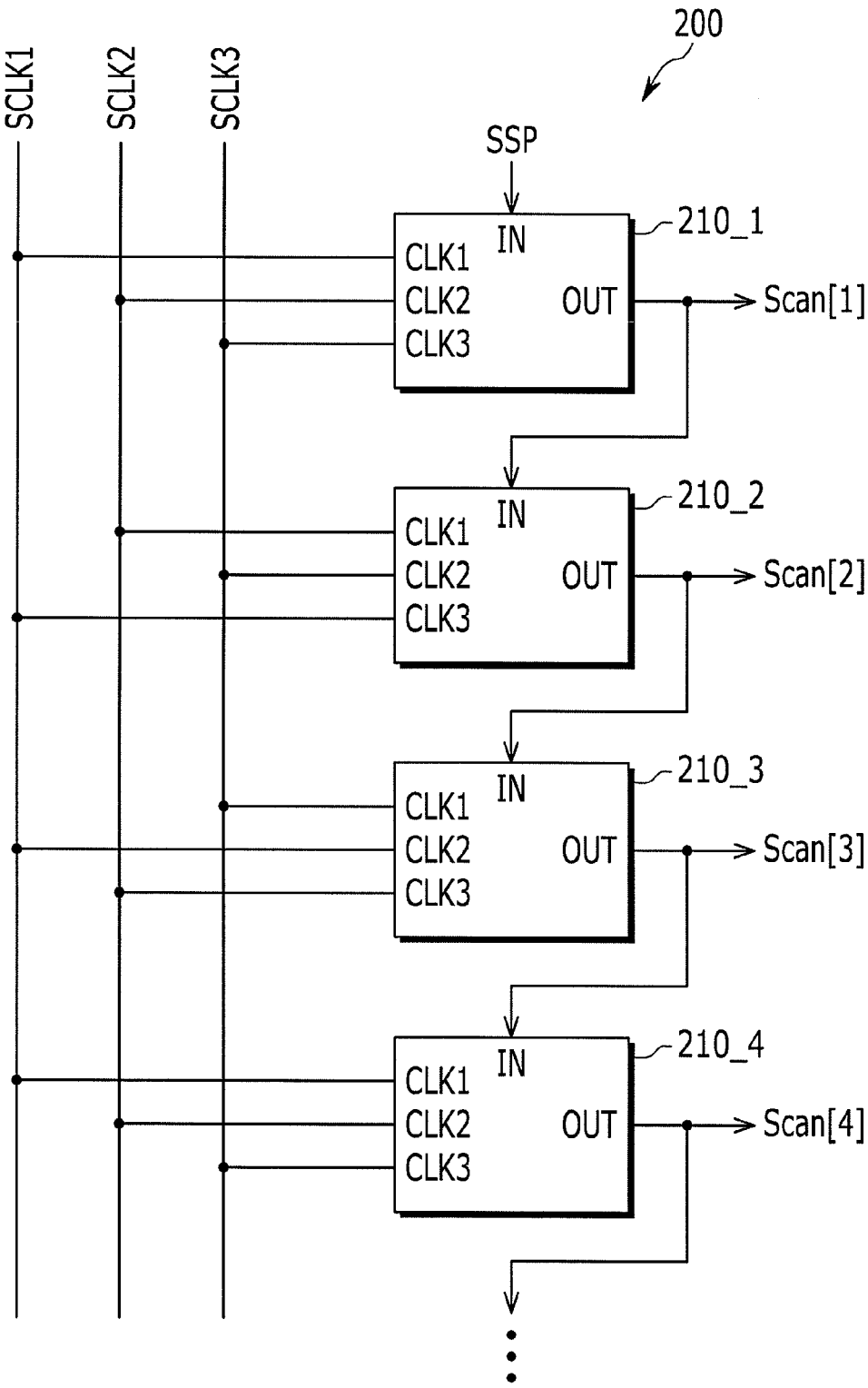
FIG. 2 shows a block diagram of a scan driving device according to an exemplary embodiment.

FIG. 2 shows a block diagram of the scan driving device 200 according to an exemplary embodiment.

Referring to FIG. 2, the scan driving device 200 includes a plurality of scan driving blocks (210_1, 210_2, 210_3, 210_4, . . . ) that are sequentially arranged. The respective scan driving blocks (210_1, 210_2, 210_3, 210_4, . . . ) generate scan signals (Scan[1], Scan[2], Scan[3], Scan[4], . . . ) that are transmitted to the scan lines S1-Sn.

The scan driving blocks (210_1, 210_2, 210_3, 210_4, . . . ) respectively include a first clock signal input terminal CLK1, a second clock signal input terminal CLK2, a third clock signal input terminal CLK3, an input signal input terminal (IN), and an output terminal (OUT).

A first scan clock signal (SCLK1), a second scan clock signal (SCLK2), and a third scan clock signal (SCLK3) are input to different clock signal input terminals in the three scan driving blocks that are continuously arranged from among the scan driving blocks (210_1, 210_2, 210_3, 210_4, . . . ).

For example, regarding the first scan driving block 210_1, the first clock signal (SCLK1) is input to the first clock signal input terminal CLK1, the second clock signal (SCLK2) is input to the second clock signal input terminal CLK2, and the third clock signal (SCLK3) is input to the third clock signal input terminal CLK3. Regarding the second scan driving block 210_2, the second clock signal (SCLK2) is input to the first clock signal input terminal CLK1, the third clock signal (SCLK3) is input to the second clock signal input terminal CLK2, and the first clock signal (SCLK1) is input to the third clock signal input terminal CLK3. Regarding the third scan driving block 210_3, the third clock signal (SCLK3) is input to the first clock signal input terminal CLK1, the first clock signal (SCLK1) is input to the second clock signal input terminal CLK2, and the second clock signal (SCLK2) is input to the third clock signal input terminal CLK3. As described above, three clock signals (SCLK1, SCLK2, SCLK3) are input to the scan driving blocks (210_1, 210_2, 210_3, 210_4, . . . ).

A scan signal of the previously arranged scan driving block is input to input signal input terminals (IN) of the scan driving blocks (210_1, 210_2, 210_3, 210_4, . . . ). A scan signal (Scan[k−1]) of the (k−1)-th scan driving block (210_*k*−1) is input to the input signal input terminal (IN) of the k-th scan driving block 210_*k*. In this instance, a scan start signal (SSP) is input to the input signal input terminal (IN) of the first scan driving block 210_1.

The respective scan driving blocks (210_1, 210_2, 210_3, 210_4, . . . ) output the generated scan signals (Scan[1], Scan[2], Scan[3], Scan[4], . . . ) to an output terminal (OUT) thereof according to the signals that are input to the first clock signal input terminal CLK1, the second clock signal input terminal CLK2, the third clock signal input terminal CLK3, and the input signal input terminal (IN).

The first scan driving block 210_1 transmits the scan signal (Scan[1]) that is generated by receiving the scan start signal (SSP) to the first scan line S1 and the input signal input terminal (IN) of the second scan driving block 210_2. The k-th arranged scan driving block 210_*k* outputs the scan signal (Scan[k]) (1<k<=n) that is generated by receiving the scan signal (Scan[k−1]) output by the (k−1)-th arranged scan driving block (210_*k*−1).

Figure 3:
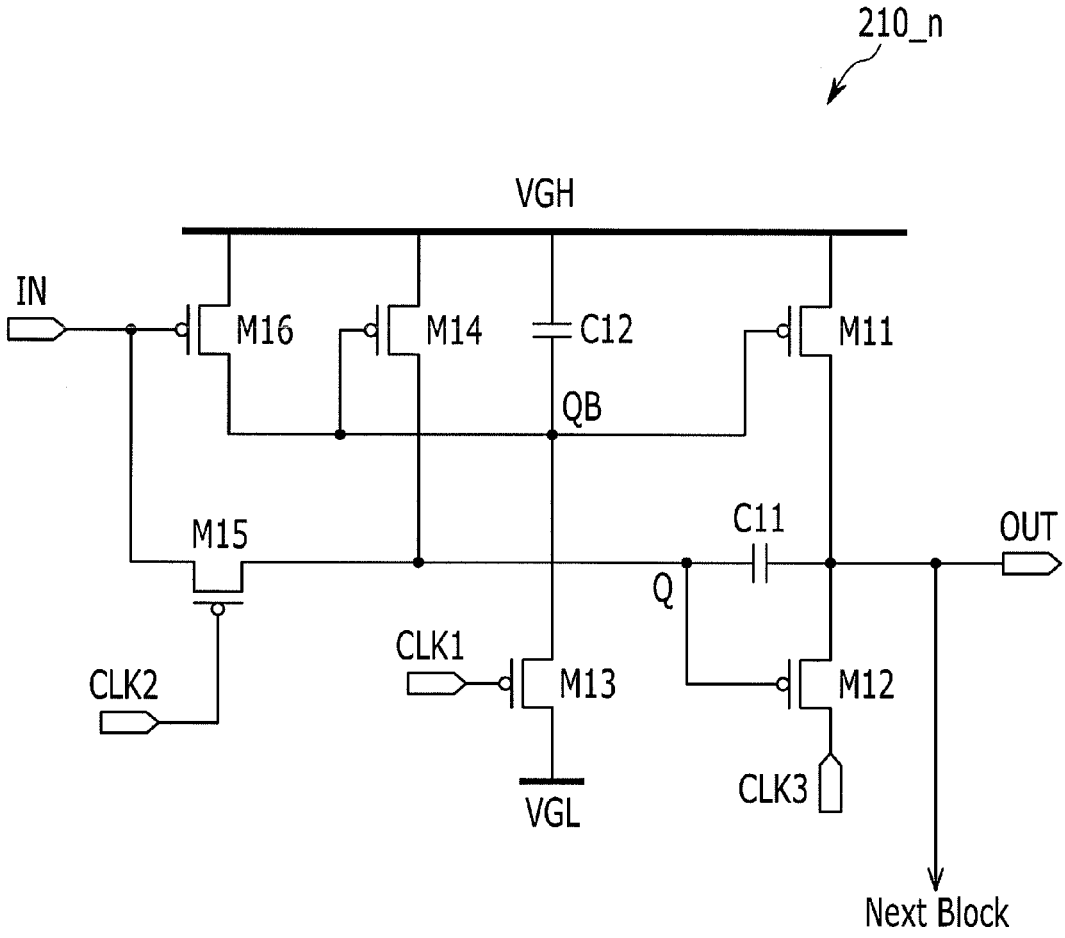
FIG. 3 shows a circuit diagram of a scan driving block in a scan driving device shown in FIG. 2 according to an exemplary embodiment.

FIG. 3 shows a circuit diagram of a scan driving block 210_*n* employable in a scan driving device shown in FIG. 2 as an exemplary embodiment, which may correspond to any one, some or all of the scan driving blocks 210_1, 210_2, 210_3, 210_4, etc.

Referring to FIG. 3, the scan driving block 210_*n* includes a plurality of transistors (M11, M12, M13, M14, M15, M16) and a plurality of capacitors C11 and C12.

The first transistor M11 includes a gate electrode connected to a first node (QB), a first electrode connected to a first power source voltage (VGH), and a second electrode connected to an output terminal (OUT).

The second transistor M12 includes a gate electrode connected to a second node (Q), a first electrode connected to the third clock signal input terminal CLK3, and a second electrode connected to the output terminal (OUT).

The third transistor M13 includes a gate electrode connected to the first clock signal input terminal CLK1, a first electrode connected to the second power source voltage (VGL), and a second electrode connected to the first node (QB).

The fourth transistor M14 includes a gate electrode connected to the first node (QB), a first electrode connected to the first power source voltage (VGH), and a second electrode connected to the second node (Q).

The fifth transistor M15 includes a gate electrode connected to the second clock signal input terminal CLK2, a first electrode connected to the input signal input terminal (IN), and a second electrode connected to the second node (Q).

The sixth transistor M16 includes a gate electrode connected to the input signal input terminal (IN), a first electrode connected to the first power source voltage (VGH), and a second electrode connected to the first node (QB).

The first capacitor C11 includes a first electrode connected to the second node (Q) and a second electrode connected to the output terminal (OUT).

The second capacitor C12 includes a first electrode connected to the first power source voltage (VGH) and a second electrode connected to the first node (QB).

The first power source voltage (VGH) has a high voltage, and the second power source voltage (VGL) has a low voltage.

The transistors (M11, M12, M13, M14, M15, M16) may include p-channel field effect transistors. The gate on voltage for turning on the transistors (M11, M12, M13, M14, M15, M16) is a low voltage and the gate off voltage for turning the same off is a high voltage. In one or more embodiments, the transistors (M11, M12, M13, M14, M15, M16) can be n-channel field effect transistors, and in this instance, the gate on voltage for turning on the n-channel field effect transistors is a high voltage and the gate off voltage for turning the same off is a low voltage.

Figure 4:
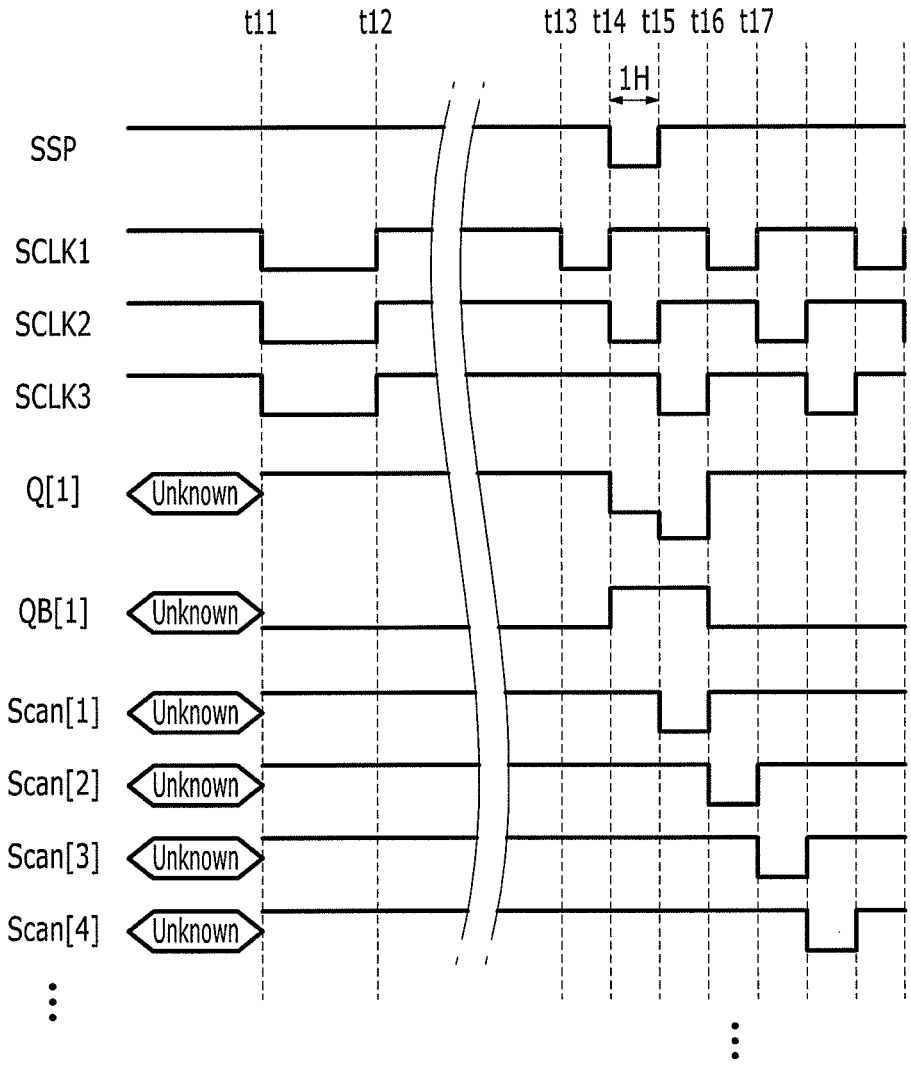
FIG. 4 shows a timing diagram of a method for driving a scan driving device shown in FIG. 2.

FIG. 4 shows a timing diagram of a method for driving the scan driving device 200 shown in FIG. 2.

Referring to FIGS. 2 to 4, during an initial driving period, the scan driving device resets the scan driving blocks (210_1, 210_2, 210_3, 210_4, . . . ) and sequentially outputs scan signals (Scan[1], Scan[2], Scan[3], Scan[4], . . . ) of the gate on voltage to the scan lines S1-Sn.

For better understanding and ease of description, the voltages at the first node (QB) and the second node (Q) of the scan driving block will be exemplified with the voltage at the first node (QB[1]) and the second node (Q[1]) of the first scan driving block 210_1.

An interval prior to t11 represents a stage before the scan driving device 200 is driven. For example, the interval prior to t11 indicates a stage before power of the scan driving device 200 is turned on. The voltages at the first node (QB[1]) and the second node (Q[1]) signify unknown states. The scan signal of the scan driving block 210_1 is output according to the voltage at the first node (QB[1]) and the voltage at the second node (Q[1]) so the voltage level of the scan signal (Scan[1]) output by the scan driving block 210_1 is also unknown. That is, the voltage levels of the scan signals (Scan[1], Scan[2], Scan[3], Scan[4], . . . ) output by the scan driving blocks (210_1, 210_2, 210_3, 210_4, . . . ) are unknown.

During the interval t11-t12, a plurality of scan driving blocks (210_1, 210_2, 210_3, 210_4, . . . ) are reset during the initial driving period. In the interval t11-t12, the scan start signal (SSP) is applied as a high voltage, and the first clock signal (SCLK1), the second clock signal (SCLK2), and the third clock signal (SCLK3) are applied as low voltages.

During the interval t11-t12, the third transistor M13 of the first scan driving block 210_1 is turned on to transmit the second power source voltage (VGL) to the first node (QB[1]). The voltage at the first node (QB[1]) becomes low. The first transistor M11 and the fourth transistor M14 are turned on by the low voltage at the first node (QB[1]). The first power source voltage (VGH) is transmitted to the output terminal (OUT) through the first transistor M11 to output the high scan signal (Scan[1]). The first power source voltage (VGH) is transmitted to the second node (Q[1]) through the fourth transistor M14. The fifth transistor M15 is turned on and a high scan start signal (SSP) is transmitted to the second node (Q[1]). The voltage at the second node (Q[1]) becomes high. The second transistor M12 is turned off by the high voltage at the second node (Q[1]). The scan signal output to the output terminal (OUT) is not influenced by the clock signal input to the third clock signal input terminal CLK3.

During the interval t11-t12, three clock signals (SCLK1, SCLK2, SCLK3) are applied as low voltages, the scan driving blocks (210_1, 210_2, 210_3, 210_4, . . . ) are operable in a like manner. That is, the first node (QB) of the scan driving blocks (210_1, 210_2, 210_3, 210_4, . . . ) is reset with the low voltage and the second node (Q) is reset with the high voltage.

In the interval after t13, the scan driving blocks (210_1, 210_2, 210_3, 210_4, . . . ) sequentially output the scan signals (Scan[1], Scan[2], Scan[3], Scan[4], . . . ) with a gate on voltage to the scan lines S1-Sn. In the interval after t13, the first clock signal (SCLK1) is applied as a clock signal having three horizontal periods 3H and a duty of one horizontal period. The duty of the clock signal represents an interval during which a gate on voltage for turning on a transistor included in the scan driving block is applied. The second clock signal (SCLK2) represents a signal that is generated by shifting the first clock signal (SCLK1) by one duty of the first clock signal (SCLK1). The third clock signal (SCLK3) represents a signal that is generated by shifting the second clock signal (SCLK2) by one duty of the second clock signal (SCLK2).

During the interval t13-t14, the first clock signal (SCLK1) is applied as a low voltage. The third transistor M13 of the first scan driving block 210_1 is turned on, and the second power source voltage (VGL) is transmitted to the first node (QB[1]). The first transistor M11 and the fourth transistor M14 are turned on. The first power source voltage (VGH) is transmitted to the output terminal (OUT) through the first transistor M11 to thus output a low scan signal (Scan[1]). The first power source voltage (VGH) is transmitted to the second node (Q[1]) through the fourth transistor M14, and the second transistor M12 is turned off.

During the interval t14-t15, the scan start signal (SSP) and the second clock signal (SCLK2) are applied as low voltages. The fifth transistor M15 and the sixth transistor M16 of the first scan driving block 210_1 are turned on. The low voltage is transmitted to the second node (Q[1]) through the fifth transistor M15, and the voltage at the second node (Q[1]) becomes low. The second transistor M12 is turned on and the high voltage is transmitted to the output terminal (OUT). The first capacitor C11 is charged by a voltage difference between the low voltage at the second node (Q[1]) and the high voltage at the output terminal (OUT). The first power source voltage (VGH) is transmitted to the first node (QB[1]) through the sixth transistor M16, and the first transistor M11 is turned off.

During the interval t15-t16, the third clock signal (SCLK3) is applied as a low voltage. When the third clock signal (SCLK3) is switched to the low voltage, the second transistor M12 of the first scan driving block 210_1 is turned on by a bootstrap through the first capacitor C11. The low voltage is transmitted to the output terminal (OUT) through the second transistor M12 to output a low scan signal (Scan[1]). The low scan signal (Scan[1]) of the first scan driving block 210_1 is applied to the input signal input terminal of the second scan driving block 210_2, and the second scan driving block 210_2 is operated in a like manner of the first scan driving block 210_1 during the interval t14-t15.

During the interval t16-t17, the second scan driving block 210_2 is operated in a like manner of the first scan driving block 210_1 during the interval t15-t16 to thus output a low scan signal (Scan[2]).

According to the above-described method, the scan driving blocks (210_1, 210_2, 210_3, 210_4, . . . ) sequentially output low scan signals (Scan[1], Scan[2], Scan[3], Scan[4], . . . ).

Assuming that an operation to sequentially output scan signals with the interval t11-t12 during which the scan driving blocks (210_1, 210_2, 210_3, 210_4, . . . ) are reset is started, an initial state of the first node (QB) of a random one of the scan driving blocks (210_1, 210_2, 210_3, 210_4, . . . ) can have a voltage that is close to the first power source voltage (VGH) so the second node (Q) floats. In this instance, when a low clock signal is input to the third clock signal input terminal CLK3, the voltage at the second node (Q) is further reduced by a bootstrap through the first capacitor C11, and an undesired low scan signal is output to the output terminal (OUT). When a random scan driving block outputs a low scan signal, the subsequently arranged scan driving blocks sequentially output low scan signals. That is, the scan driving device is abnormally operated and may thus output undesired scan signals.

In one or more embodiments, the scan driving device 200 resets the first node (QB) of the scan driving blocks (210_1, 210_2, 210_3, 210_4, . . . ) to a low voltage through the reset interval t11-t12 and resets the second node (Q) to a high voltage during an initial driving period, thereby preventing the undesired scan signal from being output.

Figure 5:
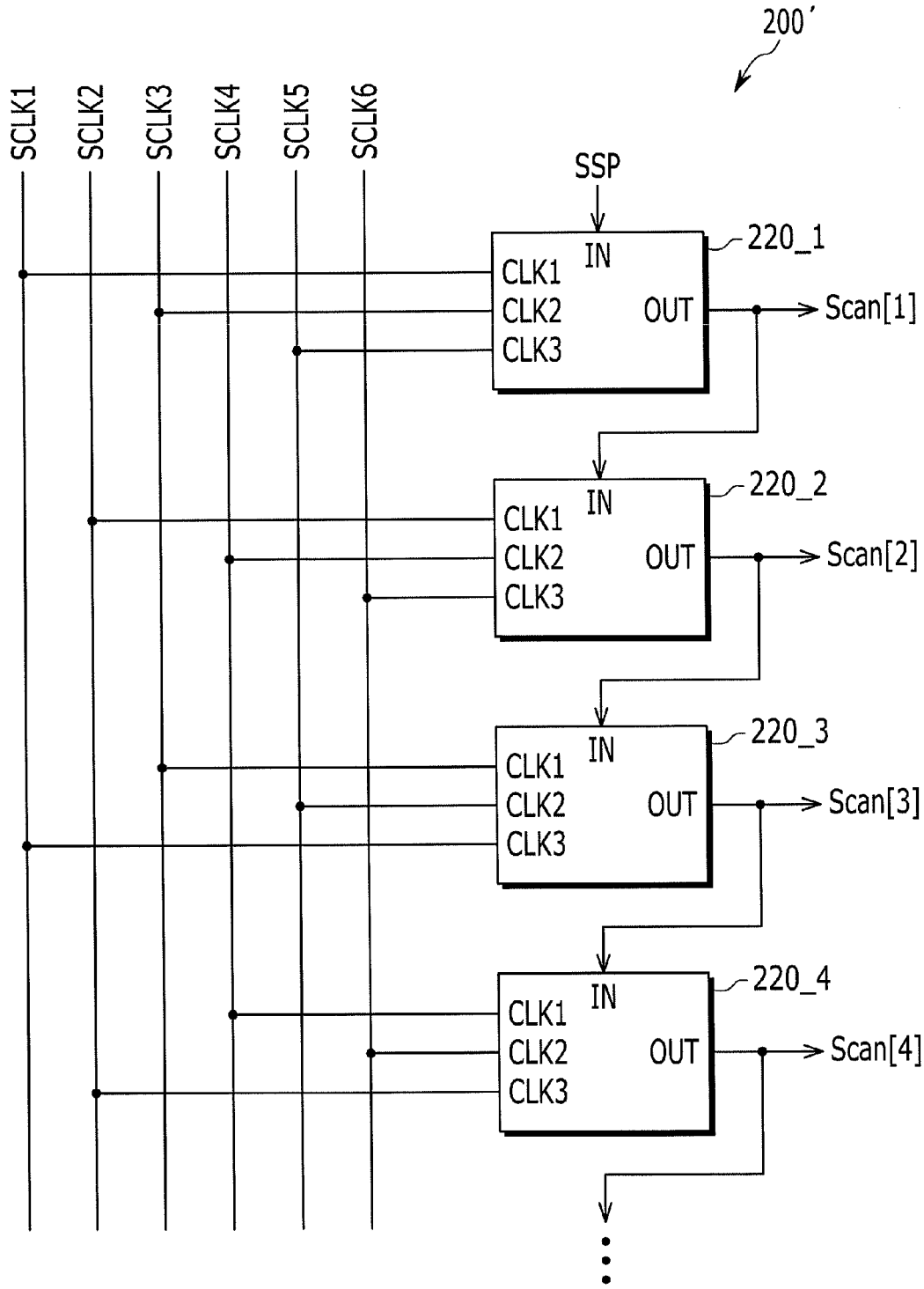
FIG. 5 shows a block diagram of a scan driving device according to another exemplary embodiment.

FIG. 5 shows a block diagram of a scan driving device 200' according to another exemplary embodiment.

Referring to FIG. 5, the scan driving device 200' includes a plurality of scan driving blocks (220_1, 220_2, 220_3, 220_4, . . . ) that are sequentially arranged. The respective scan driving blocks (220_1, 220_2, 220_3, 220_4, . . . ) can be configured in a like manner of the scan driving block 200 shown in FIG. 3.

The scan driving device shown in FIG. 5 uses six clock signals (SCLK1, SCLK2, SCLK3, SCLK4, SCLK5, SCLK6) while the scan driving device shown in FIG. 2 uses three clock signals (SCLK1, SCLK2, SCLK3).

The first clock signal (SCLK1), the third clock signal (SCLK3), and the fifth clock signal (SCLK5) are input to the first clock signal input terminal CLK1, the second clock signal input terminal CLK2, and the third clock signal input terminal CLK3 of the first scan driving block 220_1, respectively.

The second clock signal (SCLK2), the fourth clock signal (SCLK4), and the sixth clock signal (SCLK5) that are generated by shifting the clock signals that are input to the first scan driving block 220_1 by a half duty are input to the first clock signal input terminal CLK1, the second clock signal input terminal CLK2, and the third clock signal input terminal CLK3 of the second scan driving block 220_2, respectively.

The third clock signal (SCLK3), the fifth clock signal (SCLK5), and the first clock signal (SCLK1) that are generated by shifting the clock signals that are input to the second scan driving block 220_2 by a half duty are input to the first clock signal input terminal CLK1, the second clock signal input terminal CLK2, and the third clock signal input terminal CLK3 of the third scan driving block 220_3, respectively.

As described, three of the six clock signals (SCLK1, SCLK2, SCLK3, SCLK4, SCLK5, SCLK6) are applied to the scan driving blocks (220_1, 220_2, 220_3, 220_4, . . . ).

The scan signals of the previously arranged scan driving blocks are input to the input signal input terminals (IN) of the scan driving blocks (220_1, 220_2, 220_3, 220_4, . . . ). The scan signal (Scan[k−1]) of the (k−1)-th scan driving block (220_*k*−1) is input to the input signal input terminal (IN) of the k-th scan driving block 220_*k*. In this instance, a scan start signal (SSP) is input to the input signal input terminal (IN) of the first scan driving block 220_1.

Figure 6:
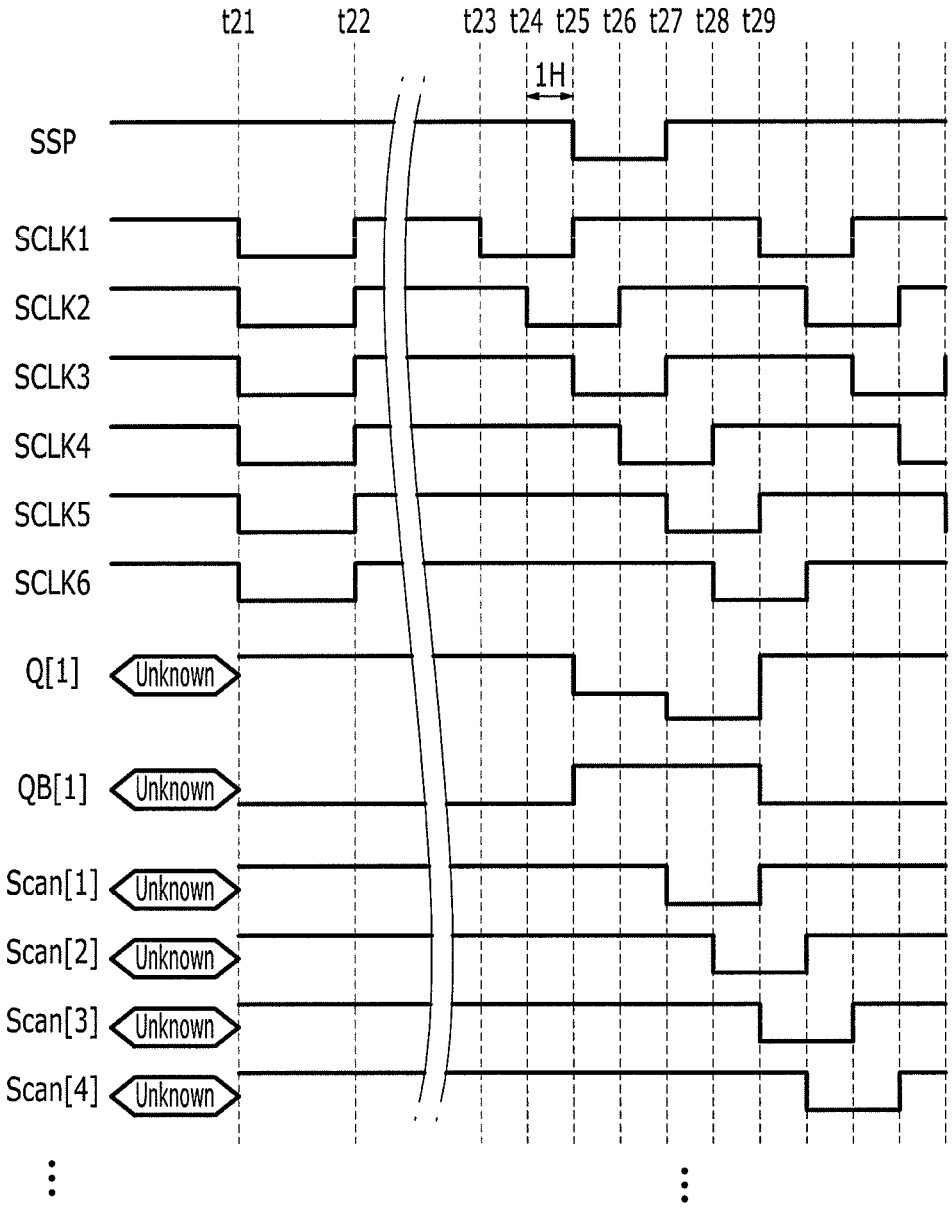
FIG. 6 shows a timing diagram of a method for driving a scan driving device shown in FIG. 5.

FIG. 6 shows a timing diagram of a method for driving the scan driving device 200' shown in FIG. 5.

Referring to FIGS. 3, 5, and 6, in a like manner of the scan driving device 200 shown in FIG. 2, the scan driving device 200' shown in FIG. 5 resets the scan driving blocks (220_1, 220_2, 220_3, 220_4, . . . ) and sequentially outputs scan signals (Scan[1], Scan[2], Scan[3], Scan[4], . . . ) with a gate on voltage to the scan line S1-Sn during an initial driving period.

The scan driving device 200' will now be described focusing on the differences from the method for driving the scan driving device 200 of FIG. 2.

During the interval t21-t22 in which the scan driving blocks (220_1, 220_2, 220_3, 220_4, . . . ) are reset, the scan start signal (SSP) is applied as a high voltage, and the clock signals (SCLK1, SCLK2, SCLK3, SCLK4, SCLK5, SCLK6) are applied as low voltages. Since the clock signals (SCLK1, SCLK2, SCLK3, SCLK4, SCLK5, SCLK6) are applied as low voltages, the scan driving blocks (220_1, 220_2, 220_3, 220_4, . . . ) are operated in a like manner, the first node (QB) of the scan driving blocks (220_1, 220_2, 220_3, 220_4, . . . ) is reset by the low voltage, and the second node (Q) is reset by the high voltage.

In one or more embodiments, the scan driving device 200' resets the first node (QB) of the respective scan driving blocks (220_1, 220_2, 220_3, 220_4, . . . ) to the low voltage and resets the second node (Q) to the high voltage through the reset interval t21-t22 during an initial driving period, and may thereby prevent output of undesired scan signals.

During the interval after t23, the scan driving blocks (220_1, 220_2, 220_3, 220_4, . . . ) sequentially output the scan signals (Scan[1], Scan[2], Scan[3], Scan[4], . . . ) with a gate on voltage to the scan lines S1-Sn. During the interval after t23, the first clock signal (SCLK1) is applied as a clock signal having six horizontal periods 6H and a duty with two horizontal periods 2H. The second clock signal (SCLK2) is a signal that is generated by shifting the first clock signal (SCLK1) by a half duty of the first clock signal (SCLK1). The third clock signal (SCLK3) is a signal that is generated by shifting the second clock signal (SCLK2) by a half duty of the second clock signal (SCLK2). The fourth clock signal (SCLK4) is a signal that is generated by shifting the third clock signal (SCLK3) by a half duty of the third clock signal (SCLK3). The fifth clock signal (SCLK5) is a signal that is generated by shifting the fourth clock signal (SCLK4) by a half duty of the fourth clock signal (SCLK4). The sixth clock signal (SCLK6) is a signal that is generated by shifting the fifth clock signal (SCLK5) by a half duty of the fifth clock signal (SCLK5).

During the interval t23-t25, the first scan driving block 220_1 is operable in a like manner of the operation that is described with reference to the interval t13-t14 of FIG. 4. During the interval t25-t27, the first scan driving block 220_1 is operable in a like manner of the operation that is described with reference to the interval t14-t15 of FIG. 4. During the interval t27-t29, first scan driving block 220_1 is operable in a like manner of the operation that is described with reference to the interval t15-t16 of FIG. 4.

The first scan driving block 220_1 outputs a low scan signal (Scan[1]) during the interval t27-t29. The second scan driving block 220_2 outputs a low scan signal (Scan[2]) that is delayed more than the low scan signal (Scan[1]) of the first scan driving block 220_1 by half. Accordingly, the scan driving blocks (220_1, 220_2, 220_3, 220_4, . . . ) sequentially output Low scan signals (Scan[1], Scan[2], Scan[3], Scan[4], . . . ) with two horizontal periods 2H that are overlapped by one horizontal period 1H.

Figure 7:
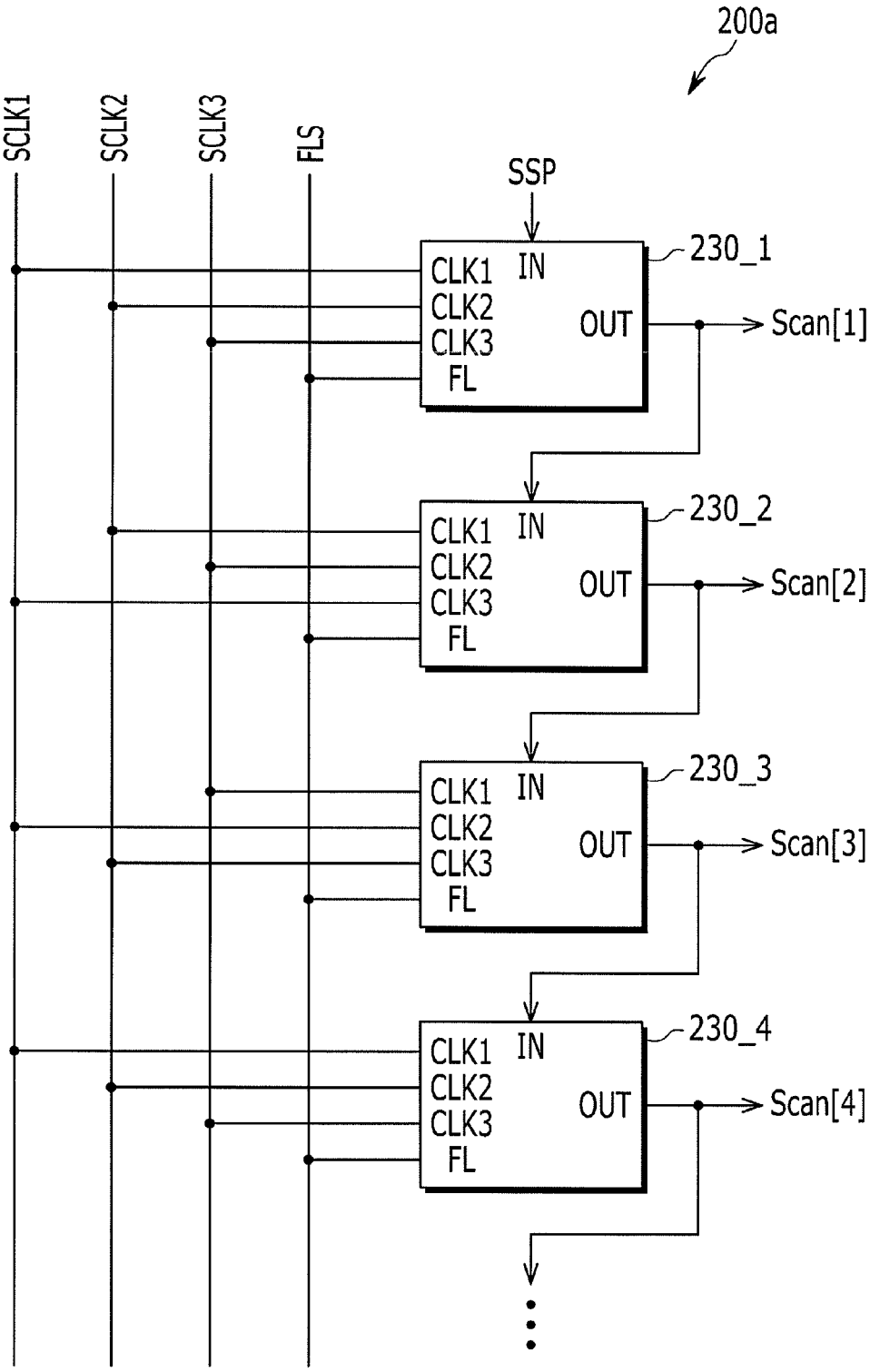
FIG. 7 shows a block diagram of a scan driving device according to the other exemplary embodiment.

FIG. 7 shows a block diagram of a scan driving device 200*a* according to another exemplary embodiment.

Referring to FIG. 7, the scan driving device 200*a* includes a plurality of scan driving blocks (230_1, 230_2, 230_3, 230_4, . . . ) that are sequentially arranged. The respective scan driving blocks (230_1, 230_2, 230_3, 230_4, . . . ) generate scan signals (Scan[1], Scan[2], Scan[3], Scan[4], . . . ) that are transmitted to the scan lines S1-Sn.

The respective scan driving blocks (230_1, 230_2, 230_3, 230_4, . . . ) include a first clock signal input terminal CLK1, a second clock signal input terminal CLK2, a third clock signal input terminal CLK3, a floating signal input terminal (FL), an input signal input terminal (IN), and an output terminal (OUT).

A first scan clock signal (SCLK1), a second scan clock signal (SCLK2), and a third scan clock signal (SCLK3) are input to different clock signal input terminals in three sequentially arranged scan driving blocks from among a plurality of scan driving blocks (230_1, 230_2, 230_3, 230_4, . . . ).

For example, in the first scan driving block 230_1, the first clock signal (SCLK1) is input to the first clock signal input terminal CLK1, the second clock signal (SCLK2) is input to the second clock signal input terminal CLK2, and the third clock signal (SCLK3) is input to the third clock signal input terminal CLK3. In the second scan driving block 230_2, the second clock signal (SCLK2) is input to the first clock signal input terminal CLK1, the third clock signal (SCLK3) is input to the second clock signal input terminal CLK2, and the first clock signal (SCLK1) is input to the third clock signal input terminal CLK3. In the third scan driving block 2303, the third clock signal (SCLK3) is input to the first clock signal input terminal CLK1, the first clock signal (SCLK1) is input to the second clock signal input terminal CLK2, and the second clock signal (SCLK2) is input to the third clock signal input terminal CLK3. Accordingly, the three clock signals (SCLK1, SCLK2, SCLK3) are input to each of the scan driving blocks (230_1, 230_2, 230_3, 230_4, . . . ).

A floating signal (FLS) is input to floating signal input terminals (FL) of the scan driving blocks (230_1, 230_2, 230_3, 230_4, . . . ). The floating signal (FLS) floats outputs of the scan driving blocks (230_1, 230_2, 230_3, 230_4, . . . ).

Scan signals of the previously arranged scan driving blocks are input to input signal input terminals (IN) of the scan driving blocks (230_1, 230_2, 230_3, 230_4, . . . ). A scan signal (Scan[k−1]) of the (k−1)-th scan driving block (230_*k*−1) is input to the input signal input terminal (IN) of the k-th scan driving block 230_*k*. In this instance, a scan start signal (SSP) is input to the input signal input terminal (IN) of the first scan driving block 230_1.

The respective scan driving blocks (230_1, 230_2, 230_3, 230_4, . . . ) output the generated scan signals (Scan[1], Scan[2], Scan[3], Scan[4], . . . ) to the output terminal (OUT) according to signals that are input to the first clock signal input terminal CLK1, the second clock signal input terminal CLK2, the third clock signal input terminal CLK3, the floating signal input terminal (FL), and the input signal input terminal (IN).

The first scan driving block 230_1 receives the scan start signal (SSP) and transmits the generated scan signal (Scan[1]) to the input signal input terminals (IN) of the first scan line S1 and the second scan driving block 230_2. The k-th arranged scan driving block 230_*k* outputs the generated scan signal (Scan[k]) (1<k<=n) that is generated by receiving the scan signal (Scan[k−1]) that is output by the (k−1)-th arranged scan driving block (230_*k*−1).

Figure 8:
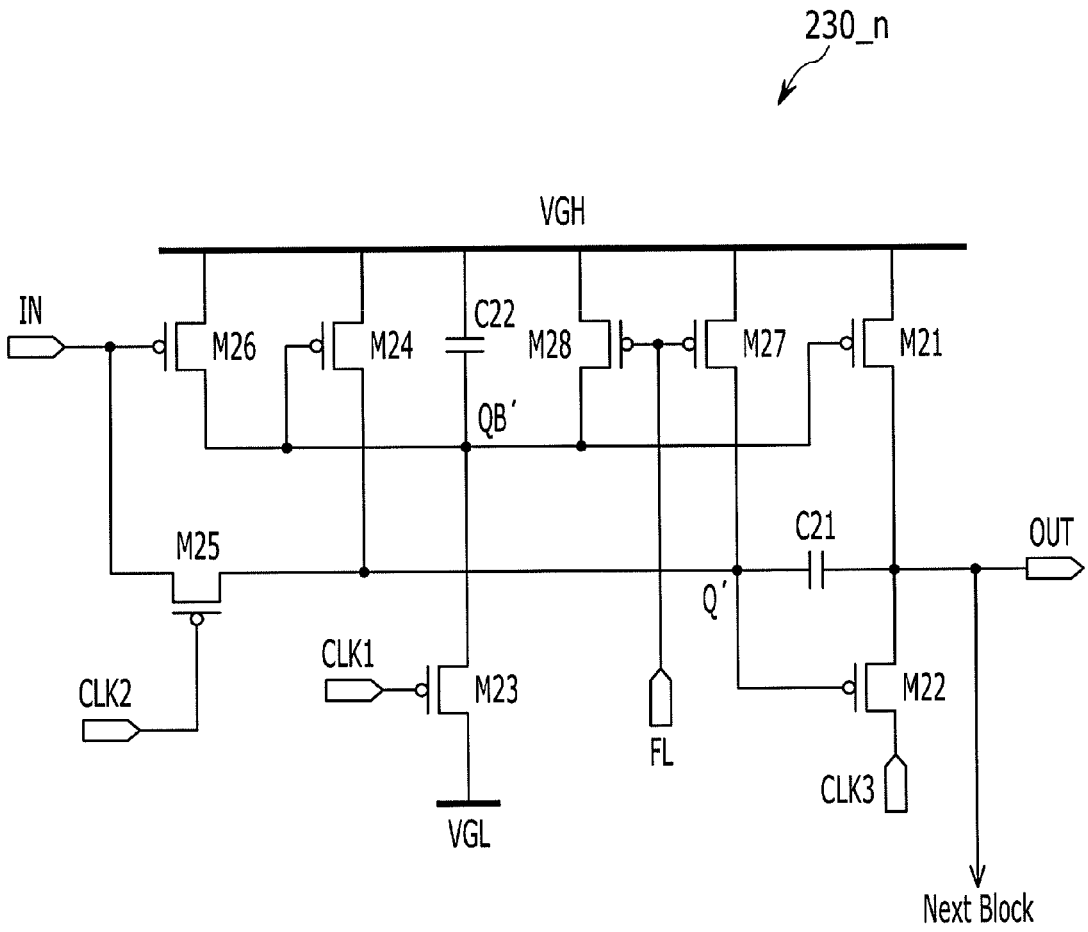
FIG. 8 shows a circuit diagram of a scan driving block in a scan driving device shown in FIG. 7 according to an exemplary embodiment.

FIG. 8 shows a circuit diagram of a scan driving block 230_*n* in the scan driving device 200*a* shown in FIG. 7 according to an exemplary embodiment.

Referring to FIG. 8, the scan driving block 230_*n* includes a plurality of transistors (M21, M22, M23, M24, M25, M26, M27, M28) and a plurality of capacitors C21 and C22.

The first transistor M21 includes a gate electrode connected to a first node (QB'), a first electrode connected to the first power source voltage (VGH), and a second electrode connected to the output terminal (OUT).

The second transistor M22 includes a gate electrode connected to a second node (Q'), a first electrode connected to the third clock signal input terminal CLK3, and a second electrode connected to the output terminal (OUT).

The third transistor M23 includes a gate electrode connected to the first clock signal input terminal CLK1, a first electrode connected to the second power source voltage (VGL), and a second electrode connected to the first node (QB').

The fourth transistor M24 includes a gate electrode connected to the first node (QB'), a first electrode connected to the first power source voltage (VGH), and a second electrode connected to the second node (Q').

The fifth transistor M25 includes a gate electrode connected to the second clock signal input terminal CLK2, a first electrode connected to the input signal input terminal (IN), and a second electrode connected to the second node (Q').

The sixth transistor M26 includes a gate electrode connected to the input signal input terminal (IN), a first electrode connected to the first power source voltage (VGH), and a second electrode connected to the first node (QB').

The seventh transistor M27 includes a gate electrode connected to the floating signal input terminal (FL), a first electrode connected to the first power source voltage (VGH), and a second electrode connected to the second node (Q').

The eighth transistor M28 includes a gate electrode connected to the floating signal input terminal (FL), a first electrode connected to the first power source voltage (VGH), and a second electrode connected to the first node (QB').

The first capacitor C21 includes a first electrode connected to the second node (Q') and a second electrode connected to the output terminal (OUT).

The second capacitor C22 includes a first electrode connected to the first power source voltage (VGH) and a second electrode connected to the first node (QB').

The first power source voltage (VGH) has a high voltage, and the second power source voltage (VGL) has a low voltage.

Compared to the scan driving block 210_*n* shown in FIG. 3, the scan driving block 230_*n* further includes a seventh transistor M27 and an eighth transistor M28.

A plurality of transistors (M21, M22, M23, M24, M25, M26, M27, M28) include p-channel field effect transistors. A gate on voltage for turning on the transistors (M21, M22, M23, M24, M25, M26, M27, M28) represents any relatively low voltage, which when applied to the respective transistor would turn on or maintain in an on-state the respective transistor, and a gate off voltage for turning the same off represents any relatively high voltage, which when applied to the respective transistor would turn off or maintain in an off-state the respective transistor. The transistors (M21, M22, M23, M24, M25, M26, M27, M28) can be, e.g., n-channel field effect transistors, and in this instance, the gate on voltage for turning on the n-channel field effect transistors is a high voltage and the gate off voltage for turning them off is a low voltage.

Figure 9:
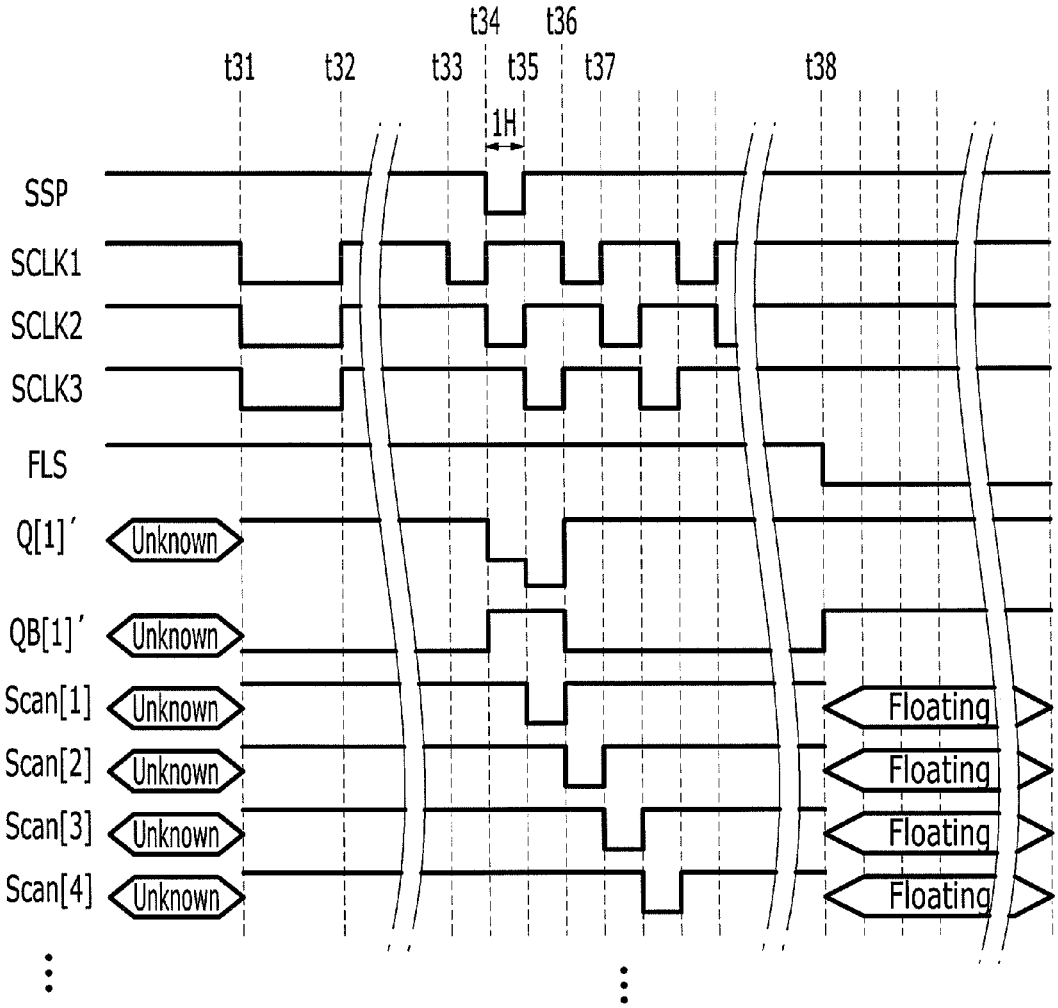
FIG. 9 shows a timing diagram of a method for driving a scan driving device shown in FIG. 7.

FIG. 9 shows a timing diagram of a method for driving the scan driving device 200*a* shown in FIG. 7.

Referring to FIG. 7 to FIG. 9, in one or more embodiments, the driving device 200*a* resets the scan driving blocks (230_1, 230_2, 230_3, 230_4, . . . ) and sequentially outputs scan signals (Scan[1],Scan[2], Scan[3], Scan[4], . . . ) with the gate on voltage to a plurality of scan lines S1-Sn at the initial drive.

For better understanding and ease of description, the voltages at the first node (QB') and the second node (Q') of the scan driving block will be exemplified with the voltages of the first node (QB[1]') and the second node (Q[1]') of the first scan driving block 230_1.

The interval before t31 represents a stage before the scan driving device is driven. For example, the interval before t31 represents a stage before the scan driving device is turned on. The voltages at the first node (QB[1]') and the second node (Q[1]') are in the unknown state. The scan signal of the scan driving block 230_1 is output according to the voltage at the first node (QB[1]') and the voltage at the second node (Q[1]') so the voltage level of the scan signal (Scan[1]) output by the scan driving block 230_1 is also unknown. That is, the voltage levels of the scan signals (Scan[1], Scan[2], Scan[3], Scan[4], . . . ) output by the scan driving blocks (230_1, 230_2, 230_3, 230_4, . . . ) are unknown.

During the interval t31-t32, a plurality of scan driving blocks (230_1, 230_2, 230_3, 230_4, . . . ) are reset at the initial drive. During the interval t31-t32, the scan start signal (SSP) and the floating signal (FLS) are applied as high voltages, and the first clock signal (SCLK1), the second clock signal (SCLK2), and the third clock signal (SCLK3) are applied as low voltages.

During the interval t31-t32, the third transistor M23 of first scan driving block 230_1 is turned on to transmit the second power source voltage (VGL) to the first node (QB[1]'). The voltage at the first node (QB[1]') becomes low. The first transistor M21 and the fourth transistor M24 are turned on by the low voltage at the first node (QB[1]'). The first power source voltage (VGH) is transmitted to the output terminal (OUT) through the first transistor M21 to output a high scan signal (Scan[1]). The first power source voltage (VGH) is transmitted to the second node (Q[1]') through the fourth transistor M24. The fifth transistor M25 is turned on and the high scan start signal (SSP) is transmitted to the second node (Q[1]'). The voltage at the second node (Q[1]') becomes high. The second transistor M22 is turned off by the High voltage at the second node (Q[1]'). The scan signal that is output to the output terminal (OUT) is not influenced by the clock signal that is input to the third clock signal input terminal CLK3.

During the interval t31-t32, the three clock signals (SCLK1, SCLK2, SCLK3) are applied as low voltages so the scan driving blocks (230_1, 230_2, 230_3, 230_4, . . . ) are operated in a like manner. That is, the first node (QB') of the scan driving blocks (230_1, 230_2, 230_3, 230_4, . . . ) is reset with a low voltage, and the second node (Q') is reset with a high voltage.

When the scan driving device is initially driven, the first node (QB') of the scan driving blocks (220_1, 220_2, 220_3, 220_4, . . . ) is reset with the low voltage, and the second node (Q') is reset with the high voltage to thus prevent output of undesired scan signals.

During the interval after t33 and before t38, the scan driving blocks (230_1, 230_2, 230_3, 230_4, . . . ) sequentially output the scan signals (Scan[1], Scan[2], Scan[3], Scan[4], . . . ) with the gate on voltage to the scan lines S1-Sn. During the interval after t33, the first clock signal (SCLK1) is applied as a clock signal with three horizontal periods 3H and a duty of one horizontal period 1H. The second clock signal (SCLK2) represents a signal that is generated by shifting the first clock signal (SCLK1) by one duty of the first clock signal (SCLK1). The third clock signal (SCLK3) represents a signal that is generated by shifting the second clock signal (SCLK2) by one duty of the second clock signal (SCLK2).

The floating signal (FLS) maintains the high voltage during the interval after t33 and before t38 so the seventh transistor M27 and the eighth transistor M28 of the scan driving blocks (230_1, 230_2, 230_3, 230_4, . . . ) are always turned off. Since the seventh transistor M27 and the eighth transistor M28 are always turned off, the scan driving device of FIG. 7 is operated during the interval after t33 and before t38 in a like manner of the scan driving device 200 of FIG. 2 after the interval t13.

In the interval after t38, the floating signal (FLS) is applied as a low voltage, and the seventh transistor M27 and the eighth transistor M28 of the scan driving blocks (230_1, 230_2, 230_3, 230_4, . . . ) are turned on, respectively. The first power source voltage (VGH) is transmitted to the first node (QB') and the second node (Q'), and the first transistor M21 and the second transistor M22 are turned off. The output terminal (OUT) becomes floating. When different scan signals or control signals are applied to a plurality of scan lines S1-Sn, the floating state of the output terminal (OUT) does not influence other scan signals or control signals.

When the output terminal (OUT) is floating, the interval t31-t32 in which the floating signal (FLS) is applied as the high voltage and a plurality of scan driving blocks (230_1, 230_2, 230_3, 230_4, . . . ) are reset and the interval t33-t38 in which the low scan signals (Scan[1], Scan[2], Scan[3], Scan[4], . . . ) are sequentially output can be performed again.

When the output terminal (OUT) is floating and the floating signal (FLS) is then applied as the high voltage, the voltages at the first node (QB') and the second node (Q') of the scan driving blocks (230_1, 230_2, 230_3, 230_4, . . . ) are maintained to be high.

Assuming that the operation of the interval t33-t38 in which the scan signals are sequentially output without the interval t31-t32 in which the scan driving blocks (230_1, 230_2, 230_3, 230_4, . . . ) are reset is started, the voltages at the first node (QB') and the second node (Q') of the scan driving blocks (230_1, 230_2, 230_3, 230_4, . . . ) are maintained at high so the second node (Q') enters the floating state.

A low clock signal is input to the third clock signal input terminal CLK3 of at least one of the scan driving blocks (230_1, 230_2, 230_3, 230_4, . . . ), the voltage at the second node (Q) is further reduced by a bootstrap through the first capacitor C21, and an undesired low scan signal is output to the output terminal (OUT). When a random scan driving block outputs a low scan signal, the subsequently arranged scan driving blocks sequentially output low scan signals. That is, the scan driving device is abnormally operated to output undesired scan signals.

In one or more embodiments, the scan driving device 200*a*' controls the output terminal (OUT) to float, resets the first node (QB) of the scan driving blocks (230_1, 230_2, 230_3, 230_4, . . . ) with the low voltage during the reset interval t31-t32, and resets the second node (Q) with the high voltage thereby preventing outputting of undesired scan signals.

Figure 10:
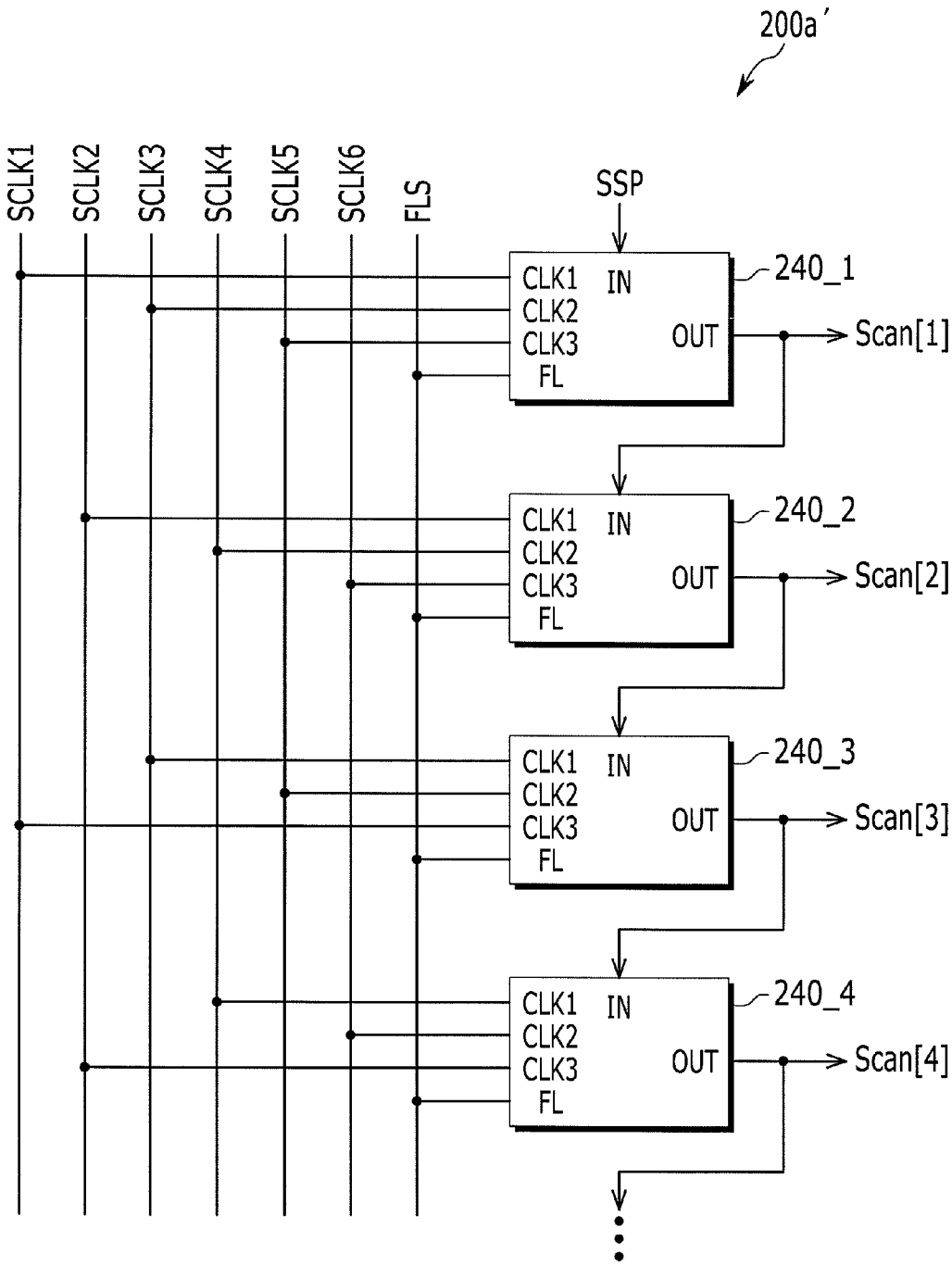
FIG. 10 shows a block diagram of a configuration of a scan driving device according to the other exemplary embodiment.

FIG. 10 shows a block diagram of a configuration of a scan driving device 200*a*' according to the other exemplary embodiment.

Referring to FIG. 10, the scan driving device 200*a*' includes a plurality of scan driving blocks (240_1, 240_2, 240_3, 240_4, . . . ) that are sequentially arranged. The scan driving blocks (240_1, 240_2, 240_3, 240_4, . . . ) can be configured in a like manner of the scan driving block 230_*n* of FIG. 8.

The scan driving device 200*a* shown in FIG. 7 uses three clock signals (SCLK1, SCLK2, SCLK3) and the scan driving device 200*a*' shown in FIG. 10 uses six clock signals (SCLK1, SCLK2, SCLK3, SCLK4, SCLK5, SCLK6).

The first clock signal (SCLK1), the third clock signal (SCLK3), and the fifth clock signal (SCLK5) are input to the first clock signal input terminal CLK1, the second clock signal input terminal CLK2, and the third clock signal input terminal CLK3 of the first scan driving block 240_1.

The second clock signal (SCLK2), the fourth clock signal (SCLK4), and the sixth clock signal (SCLK5) that are shifted by a half duty of the clock signal that is input to first scan driving block 240_1 are input to the first clock signal input terminal CLK1, the second clock signal input terminal CLK2, and the third clock signal input terminal CLK3 of the second scan driving block 240_2.

The third clock signal (SCLK3), the fifth clock signal (SCLK5), and the first clock signal (SCLK1) that are shifted by a half of the clock signal that is input to the second scan driving block 240_2 are input to the first clock signal input terminal CLK1, the second clock signal input terminal CLK2, and the third clock signal input terminal CLK3 of the third scan driving block 240_3.

As described, three of the six clock signals (SCLK1, SCLK2, SCLK3, SCLK4, SCLK5, SCLK6) are applied to the scan driving blocks (240_1, 240_2, 240_3, 240_4, . . . ).

The scan signals of the previously arranged scan driving blocks are input to the input signal input terminals (IN) of the scan driving blocks (240_1, 240_2, 240_3, 240_4, . . . ). The scan signal (Scan[k−1]) of the (k−1)-th scan driving block (240_*k*−1) is input to the input signal input terminal (IN) of the k-th scan driving block 240_*k*. In this instance, the scan start signal (SSP) is input to the input signal input terminal (IN) of the first scan driving block 240_1.

Figure 11:
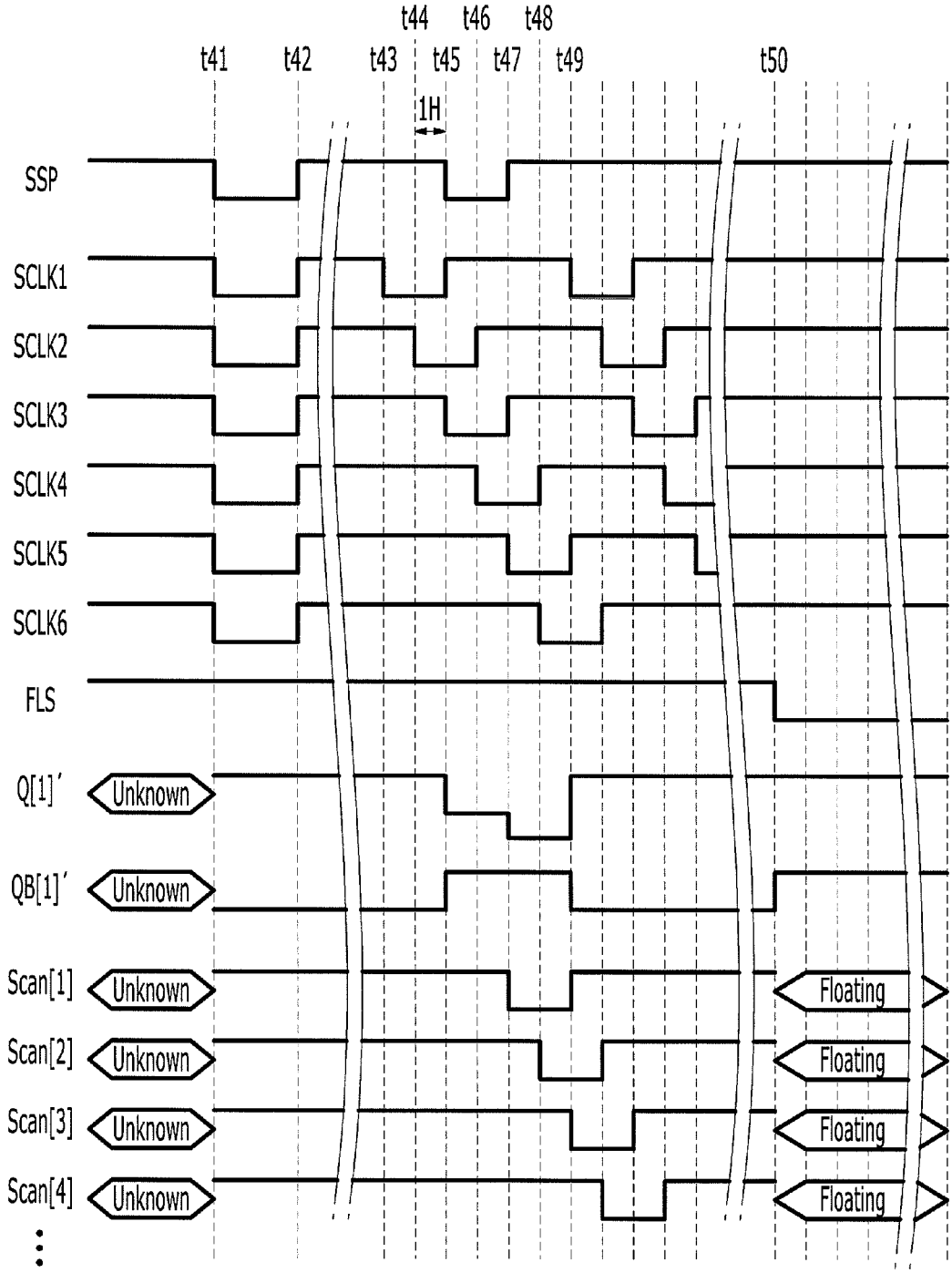
FIG. 11 shows a timing diagram of a method for driving a scan driving device shown in FIG. 10.

FIG. 11 shows a timing diagram of a method for driving the scan driving device 200*a*' shown in FIG. 10.

Referring FIGS. 8, 10, and 11, in a like manner of the scan driving device 200*a* described with reference to FIG. 7, the scan driving device 200*a*' shown in FIG. 10 resets the scan driving blocks (240_1, 240_2, 240_3, 240_4, . . . ) and sequentially outputs the scan signals (Scan[1], Scan[2], Scan[3], Scan[4], . . . ) with a gate on voltage to the scan lines S1-Sn.

A method for driving the scan driving device 200*a*' will now be described focusing on the differences from the method for driving the scan driving device 200*a* of FIG. 7

During the interval t41-t42 in which the scan driving blocks (240_1, 240_2, 240_3, 240_4, . . . ) are reset, the scan start signal (SSP) is applied as a high voltage and the clock signals (SCLK1, SCLK2, SCLK3, SCLK4, SCLK5, SCLK6) are applied as low voltages. Since the clock signals (SCLK1, SCLK2, SCLK3, SCLK4, SCLK5, SCLK6) are applied as low voltages, the scan driving blocks (240_1, 240_2, 240_3, 240_4, . . . ) are operated in a like manner, the first node (QB') of the scan driving blocks (240_1, 240_2, 240_3, 240_4, . . . ) is reset with the low voltage, and the second node (Q') is reset with the high voltage.

The scan driving device 200*a*' resets the first node (QB') of the scan driving blocks (240_1, 240_2, 240_3, 240_4, . . . ) with a low voltage and resets the second node (Q') with a high voltage at the initial drive during the reset interval t41-t42, thereby preventing outputting of undesired scan signals.

During the interval after t43, the scan driving blocks (240_1, 240_2, 240_3, 240_4, . . . ) sequentially output the scan signals (Scan[1], Scan[2], Scan[3], Scan[4], . . . ) with a gate on voltage to the scan lines S1-Sn. During the interval after t43, the first clock signal (SCLK1) is applied as a clock signal with six horizontal periods 6H and a duty of two horizontal periods 2H. The second clock signal (SCLK2) represents a signal that is generated by shifting the first clock signal (SCLK1) by a half duty of the first clock signal (SCLK1). The third clock signal (SCLK3) represents a signal that is generated by shifting the second clock signal (SCLK2) by a half duty of the second clock signal (SCLK2). The fourth clock signal (SCLK4) represents a signal that is generated by shifting the third clock signal (SCLK3) by a half duty of the third clock signal (SCLK3). The fifth clock signal (SCLK5) represents a signal that is generated by shifting the fourth clock signal (SCLK4) by a half duty of the fourth clock signal (SCLK4). The sixth clock signal (SCLK6) represents a signal that is generated by shifting the fifth clock signal (SCLK5) by a half duty of the fifth clock signal (SCLK5).

The first scan driving block 240_1 is operated during the interval t43-t45 in a like manner of the operation during the interval t33-t34 shown in FIG. 9. The first scan driving block 240_1 is operated during the interval t45-t47 in a like manner of the operation during the interval t34-t35 shown in FIG. 9. The first scan driving block 240_1 is operated during the interval t47-t49 in a like manner of the operation during the interval t35-t36 shown in FIG. 9.

The first scan driving block 240_1 outputs a low scan signal (Scan[1]) during the interval t47-t49. The second scan driving block 240_2 outputs a low scan signal (Scan[2]) that is delayed by a half duty more than the low scan signal (Scan[1]) of the first scan driving block 240_1. As described, the scan driving blocks (240_1, 240_2, 240_3, 240_4, . . . ) sequentially output low scan signals (Scan[1], Scan[2], Scan[3], Scan[4], . . . ) with two horizontal periods 2H that are overlapped by one horizontal period 1H.

During the interval after t50, the floating signal (FLS) is applied as a low voltage, and the seventh transistor M27 and the eighth transistor M28 of the scan driving blocks (240_1, 240_2, 240_3, 240_4, . . . ) are turned on, respectively. The first power source voltage (VGH) is transmitted to the first node (QB') and the second node (Q'), and the first transistor M21 and the second transistor M22 are turned off. The output terminal (OUT) becomes floating.

As described with reference to FIG. 9, the interval t41-t42 during which the floating signal (FLS) is applied as the high voltage and the scan driving blocks (240_1, 240_2, 240_3, 240_4, . . . ) are reset is performed when the output terminal (OUT) has floated, thereby preventing output of undesired scan signals.

The drawings and detailed description herein are to be construed as merely illustrative and not a limitation of the scope of the present invention as seen in the appended claims. Therefore, it will be appreciated by those skilled in the art that various modifications may be made and other equivalent embodiments are available. Accordingly, the actual scope of the present invention must be determined by the spirit of the appended claims.

What is claimed is:

1. A scan driving device including a plurality of scan driving blocks that are sequentially arranged, wherein the scan driving blocks respectively include:

a first node configured to receive a second power source voltage according to a clock signal that is input to a first clock signal input terminal;

a second node configured to receive a first power source voltage according to the clock signal that is input to the first clock signal input terminal, and to receive an input signal according to a clock signal that is input to a second clock signal input terminal;

a first transistor including a gate electrode that is connected to the first node, a first electrode that is connected to the first power source voltage, and a second electrode that is connected to an output terminal; and a second transistor including a gate electrode that is connected to the second node, a first electrode for receiving a clock signal that is input to a third clock signal input terminal, and a second electrode that is connected to the output terminal, wherein, during an initial driving period, the input signal is applied with a gate off voltage, and the clock signal that is input to the first clock signal input terminal, the clock signal that is input to the second clock signal input terminal, and the clock signal that is input to the third clock signal input terminal have are applied with a gate on voltage to reset a voltage at the first node with the gate on voltage and reset a voltage at the second node with the gate off voltage, and wherein the scan driving blocks output scan signals with a gate off voltage when a voltage at the first node is reset with a gate on voltage and a voltage at the second node is reset with a gate off voltage.

2. The scan driving device of claim 1, wherein the input signal represents a scan signal of a previously arranged scan driving block from among the scan driving blocks.

3. The scan driving device of claim 1, further including:

a first capacitor including a first electrode connected to the gate electrode of the second transistor and a second electrode connected to the second electrode of the second transistor.

4. The scan driving device of claim 1, further including:

a third transistor including a gate electrode connected to the first clock signal input terminal, a first electrode connected to the second power source voltage, and a second electrode connected to the first node.

5. The scan driving device of claim 1, further including:

a fourth transistor including a gate electrode connected to the first node, a first electrode connected to the first power source voltage, and a second electrode connected to the second node.

6. The scan driving device of claim 1, further including:

a fifth transistor including a gate electrode connected to the second clock signal input terminal, a first electrode configured to receive the input signal, and a second electrode connected to the second node.

7. The scan driving device of claim 1, further including:

a sixth transistor including a gate electrode for receiving the input signal, a first electrode connected to the first power source voltage, and a second electrode connected to the first node.

8. The scan driving device of claim 1, further including:

a second capacitor including a first electrode connected to the first power source voltage and a second electrode connected to the first node.

9. The scan driving device of claim 1, further including:

a seventh transistor including a gate electrode configured to receive a floating signal, a first electrode connected to the first power source voltage, and a second electrode connected to the second node.

10. The scan driving device of claim 9, further including:

an eighth transistor including a gate electrode connected to the floating signal input terminal, a first electrode connected to the first power source voltage, and a second electrode connected to the first node.

11. A method for driving a scan driving device including a plurality of scan driving blocks including:

a first node configured to receive a second power source voltage according to a clock signal that is input to a first clock signal input terminal;

a second node configured to receive a first power source voltage according to the clock signal that is input to the first clock signal input terminal, and to receive an input signal according to a clock signal that is input to a second clock signal input terminal;

a first transistor having a gate electrode connected to the first node and configured to transmit the first power source voltage to an output terminal; and a second transistor having a gate electrode connected to the second node and configured to transmit a clock signal that is input to a third clock signal input terminal to the output terminal, the method comprising:

resetting the first node of the plurality of scan driving blocks with a gate on voltage, respectively, and resetting the second node of the scan driving blocks with a gate off voltage to reset the scan driving blocks; and controlling the scan driving blocks to sequentially output scan signals, wherein resetting the first and the second nodes of the plurality of scan driving blocks includes, during an initial driving period, maintaining the input signal having a gate off voltage and maintaining the clock signal that is input to the first clock signal input terminal, the clock signal that is input to the second clock signal input terminal, and the clock signal that is input to the third clock signal input terminal having a gate on voltage.

12. The method of claim 11, wherein resetting the first node of the plurality of scan driving blocks includes:

applying the clock signal that is input to the first clock signal input terminal that is connected to a gate electrode of a third transistor to transmit the second power source voltage to the first node, wherein the second power source voltage corresponds to the gate on voltage.

13. The method of claim 12, wherein applying the clock signal that is input to the first clock signal input terminal includes:

turning on a fourth transistor by the second power source voltage to transmit the first power source voltage to the second node, the fourth transistor having a gate electrode connected to the first node and configured to transmit the first power source voltage to the second node.

14. The method of claim 11, wherein resetting the first and the second nodes of the plurality of scan driving blocks includes:

outputting scan signals with the gate off voltage at the output terminals of the scan driving blocks when a voltage at the first node is reset with the gate on voltage and a voltage at the second node is reset with the gate off voltage.

15. The method of claim 14, wherein resetting the first and the second nodes of the plurality of scan driving blocks includes:

applying the clock signal that is input to the second clock signal input terminal that is connected to a gate electrode of a fifth transistor to transmit the input signal to the second node, the input signal having a gate on voltage.

16. The method of claim 15, wherein the input signal represents a scan signal of the gate off voltage of a previously driven scan driving block.

17. The method of claim 15, wherein resetting the first and the second nodes of the plurality of scan driving blocks includes:

turning off a sixth transistor for transmitting the first power source voltage to the first node according to the input signal.

18. The method of claim 11, wherein resetting the first and the second nodes of the plurality of scan driving blocks includes:

turning off a seventh transistor for transmitting the first power source voltage to the second node according to a floating signal and an eighth transistor for transmitting the first power source voltage to the first node according to the floating signal.

19. A method for driving a scan driving device including a plurality of scan driving blocks including a first transistor having a gate electrode connected to a first node and configured to transmit a first power source voltage to an output terminal, a second transistor having a gate electrode connected to a second node and configured to transmit a clock signal to the output terminal, an eighth transistor for transmitting a gate off voltage to the first node according to a floating signal, and a seventh transistor for transmitting a gate off voltage to the second node according to the floating signal, the method comprising:

floating the output terminal by transmitting the gate off voltage to the first node and the second node of the scan driving blocks according to the floating signal;

resetting the first node of the scan driving blocks with a gate on voltage and resetting the second node of the scan driving blocks with the gate off voltage to reset the scan driving blocks; and outputting, sequentially, scan signals from the plurality of scan driving blocks.

20. A scan driving device including a plurality of scan driving blocks that are sequentially arranged, wherein the scan driving blocks respectively include:

a first node configured to receive a second power source voltage according to a clock signal that is input to a first clock signal input terminal;

a second node configured to receive a first power source voltage according to the clock signal that is input to the first clock signal input terminal, and to receive an input signal according to a clock signal that is input to a second clock signal input terminal;

a first transistor including a gate electrode that is connected to the first node, a first electrode that is connected to the first power source voltage, and a second electrode that is connected to an output terminal;

a second transistor including a gate electrode that is connected to the second node, a first electrode for receiving a clock signal that is input to a third clock signal input terminal, and a second electrode that is connected to the output terminal;

a seventh transistor including a gate electrode configured to receive a floating signal, a first electrode connected to the first power source voltage, and a second electrode connected to the second node; and an eighth transistor including a gate electrode connected to an input terminal of the floating signal, a first electrode connected to the first power source voltage, and a second electrode connected to the first node, wherein when the seventh transistor and the eighth transistor are turned on by the floating signal, the output terminal is floating.

* * * * *